US007597213B2

(12) United States Patent
McDonald

(10) Patent No.: US 7,597,213 B2
(45) Date of Patent: Oct. 6, 2009

(54) CONTAINER CAPS AND CONTAINERS

(75) Inventor: Duane Lyle McDonald, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 948 days.

(21) Appl. No.: 11/021,317

(22) Filed: Dec. 22, 2004

(65) Prior Publication Data

US 2006/0131319 A1 Jun. 22, 2006

(51) Int. Cl.
*A47K 10/24* (2006.01)

(52) U.S. Cl. ..... 221/46; 221/49; 221/63; 221/307; 220/229; 220/787; 220/789; 220/801

(58) Field of Classification Search ..... 221/63, 221/46, 49, 307; 220/787, 789, 801, 229
See application file for complete search history.

(56) References Cited

U.S. PATENT DOCUMENTS 3,836,044 A * 9/1974 Tilp et al. ..... 221/55
3,990,604 A * 11/1976 Barnett et al. ..... 220/320
4,211,336 A * 7/1980 Helms ..... 220/270
4,883,194 A * 11/1989 Fernandes ..... 220/787
5,085,339 A * 2/1992 Roth et al. ..... 220/270
5,542,598 A * 8/1996 Capo ..... 221/45
5,647,501 A 7/1997 Helms
6,053,353 A 4/2000 Helms
6,196,451 B1 3/2001 Helms
6,213,345 B1 * 4/2001 Plank ..... 221/46
6,220,435 B1 4/2001 Nobile et al.
6,318,590 B1 * 11/2001 McMurray-Stivers ..... 221/45
6,471,083 B1 10/2002 Helms
6,523,690 B1 * 2/2003 Buck et al. ..... 221/63
6,523,713 B1 2/2003 Helms
6,585,131 B2 7/2003 Huang et al.
6,592,004 B2 7/2003 Huang et al.
6,766,919 B2 7/2004 Huang et al.

FOREIGN PATENT DOCUMENTS

EP 0 760 343 A1 3/1997
WO WO 2004/080705 9/2004

* cited by examiner

*Primary Examiner*—Gene Crawford
*Assistant Examiner*—Timothy R Waggoner
(74) *Attorney, Agent, or Firm*—Gregory E. Croft; Scott A. Baum

(57) ABSTRACT

A container cap can comprise: a covering comprising a first panel, a skirt in contact with the first panel, and a dispensing window attached to the first side of the first panel. The first panel can have an outer periphery and an inner periphery and a first side and a second side. The dispensing window can be attached to the first side of the first panel. The dispensing window can have a dispensing aperture capable of allowing dispensing of an article through the dispensing aperture.

33 Claims, 5 Drawing Sheets

CONTAINER CAPS AND CONTAINERS

BACKGROUND

This disclosure relates to container caps for dispensing disposable sheets.

Disposable sheet dispensers comprising a container with a stack or clip of pre-folded sheets within the container are commercially available. These containers generally have a rectangular geometry with a closed lower end and an open upper end. The open upper end can have a poly film bonded to the cardboard or the paperboard forming the sides and part of the open upper end. For example, a box of Kleenex® brand tissue has a poly film top that has an opening therethrough such that tissue can be dispensed through the opening.

However, there remains a need for different dispensing designs having a readily dispensible article therein, and more particularly, for design adaptable to a wide variety of container shapes and sizes.

BRIEF SUMMARY

Disclosed herein are container caps and containers for dispensing disposable sheets. In one embodiment, a container cap can comprise: a covering comprising a first panel, a skirt in contact with the first panel, and a dispensing window. The first panel can have an outer periphery and an inner periphery and a first side and a second side. The dispensing window can be attached to the first side of the first panel. The dispensing window can have a dispensing aperture capable of allowing dispensing of an article through the dispensing aperture.

In another embodiment, a container cap can comprise: a covering comprising a first panel and a second panel, a skirt in contact with the first panel, and a dispensing window. The first panel can have an outer periphery and an inner periphery and a first side and a second side. The second panel can have a removal zone and can be joined to the inner periphery of the first panel along a weakened line. The dispensing window can be attached to the first side of the first panel. The dispensing window can have a dispensing aperture capable of allowing dispensing of an article through the dispensing aperture.

In one embodiment, a container can comprise: a container body having an open end, a container inner surface, and a container outer surface, the container body capable of housing articles, and a container cap. The container cap can comprise: a covering comprising a first panel, a skirt in contact with the first panel, and a dispensing window. The first panel can have an outer periphery and an inner periphery and a first side and a second side. The dispensing window can be attached to the first side of the first panel. The dispensing window can have a dispensing aperture capable of allowing dispensing of an article from the container. The skirt can engage the container inner surface and/or the container outer surface at the open end of the container body.

The above described and other features are exemplified by the following figures and detailed description.

BRIEF DESCRIPTION OF DRAWINGS

Refer now to the figures, which are exemplary, not limiting, are not drawn to scale, and wherein like elements are numbered alike in the several figures and, as such may not be discussed in relation to each figure.

DETAILED DESCRIPTION

Disclosed herein are container caps and containers for dispensing disposable sheets. The container caps can comprise a first panel having an outer periphery and an inner periphery, a skirt in contact with the first panel, and a dispensing window attached to the first panel, wherein the inner periphery defines an opening. The skirt can be disposed about the outer periphery of the first panel and/or at least partially covered by the first panel (e.g., the first panel can extend up an outer surface of the skirt). All ranges disclosed herein are inclusive and combinable (e.g., ranges of "up to about 25 wt %, or, more specifically about 5 wt % to about 20 wt %" is inclusive of the endpoints and all intermediate values of the ranges of "about 5 wt % to about 25 wt %," etc.). The terms "first," "second," and so forth, herein do not denote any order, quantity, or importance, but rather are used to distinguish one element from another, and the terms "a" and "an" herein do not denote a limitation of quantity, but rather denote the presence of at least one of the referenced items.

Figure 1:
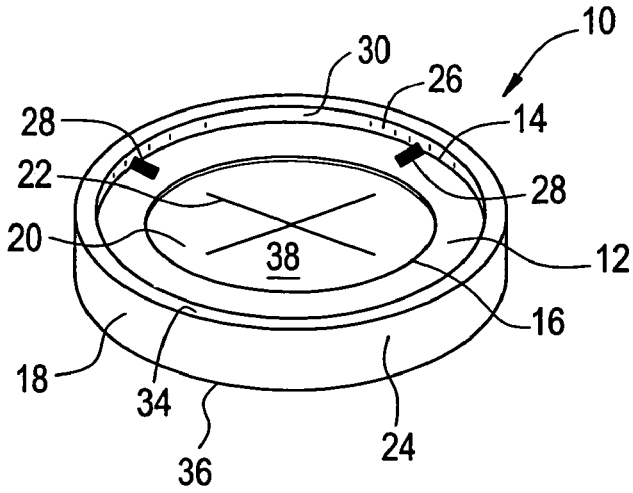
FIG. 1 is a perspective view of one embodiment of a container cap.

Referring now to FIG. 1, in one embodiment, a container cap 10 comprises a first panel 12 having an outer periphery 14 and an inner periphery 16 defining an opening, a skirt 18 disposed about the outer periphery 14 of the first panel 12, and a dispensing portion (e.g., window (which may be transparent, translucent, and/or opaque)) 20 bonded, adhered, or glued to the first panel 12. The dispensing window 20 has a dispensing aperture 22 to allow dispensing of an article from a container, passing from a second side (not shown) of the dispensing window 20 through the dispensing aperture 22 to a first side 38 of the dispensing window 20.

Figure 2:
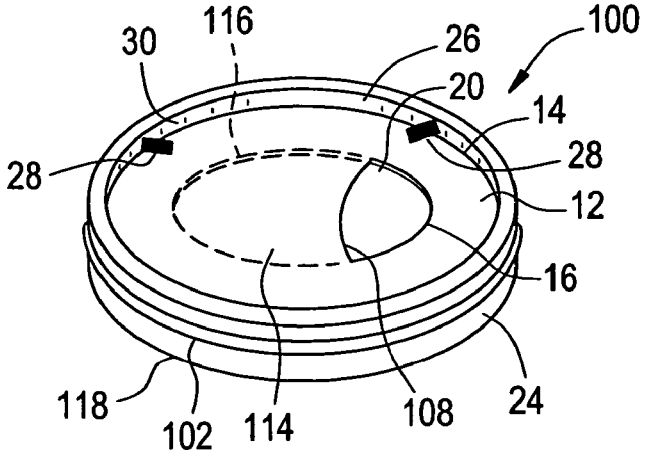
FIG. 2 is a perspective view of another embodiment of a container cap.

Alternatively, or in addition, the container cap (see 100 in FIG. 2) can further comprise a second panel 114. The second panel 114 and the first panel 12, collectively, form a covering over the dispensing window 20, which can provide tamper resistance to the container since prior removal of or damage to the second panel 114 is indicative of tampering. The covering can cover the aperture 22, e.g., to inhibit contamination of the interior of the container (e.g., of the articles in the container). The covering can comprise a line of weakness 116 (e.g., perforations or score lines) for opening and/or removal of the second panel 114 from the covering to form the inner periphery 16 of the first panel 12. The weakened line 116 enables removal of the second panel 114 while providing sufficient structural integrity until the user desires removal. To facilitate the removal of the second panel 114 from the covering along the weakened line 116, the covering can further comprise an optional removal zone, e.g., an indentation 108, an opening, a tab, and/or the like. The removal zone enables the user to grasp the second panel 114 (e.g., at the indentation 108) and separate the second panel 114 from the first panel 12, along the weakened line 116. Lifting and/or removal of the second panel 114 exposes the dispensing aperture 22 on the dispensing window 20.

Figure 4:
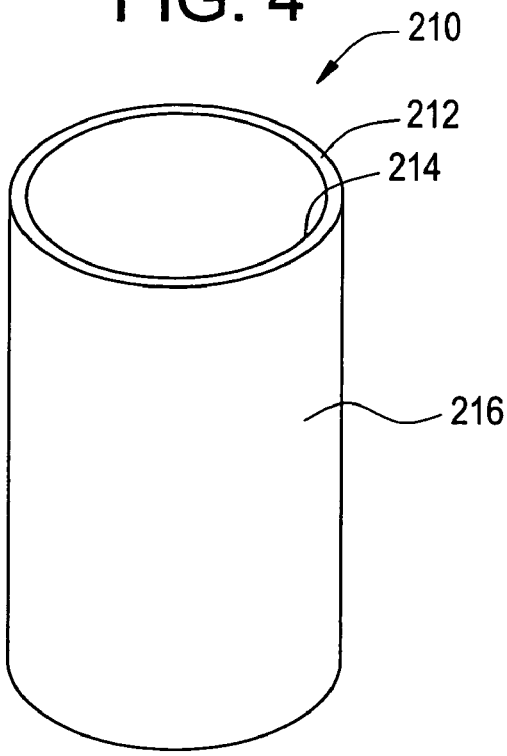
FIG. 4 is a perspective view of one embodiment of a container body.
Figure 5:
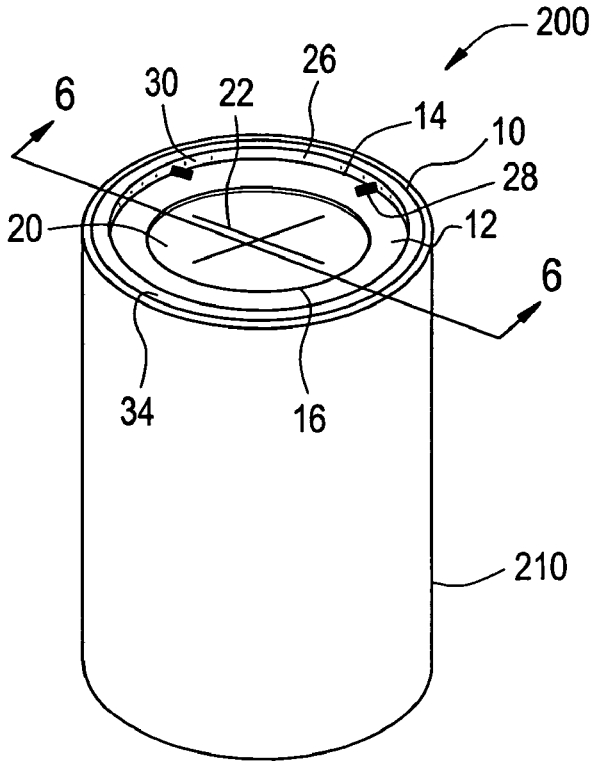
FIG. 5 is a perspective view of one embodiment of a container with a container cap for dispensing disposable sheets.

Referring to FIGS. 4 and 5, in one embodiment, a container 200 comprises a container body 210 and the container cap 10. The container body 210 has an open end 212, a container inner surface 214, and a container outer surface 216. The container body 210 can be made from various materials such as paper, wood, metal, cloth, polymeric material, and so forth, as well as combinations comprising at least one of the foregoing materials. For example, the container body can be made from paperboard, poster board, carton board, cardboard, and so forth, and combinations comprising at least one of the foregoing, and can include polymeric materials such as thermoplastic films. Additionally, although FIGS. 4 and 5 show the container body 210 in a cylindrical shape, the container body 210 can take any other desired shape. Possible shapes for the container body 210 and/or container cap include, but are not limited to, rectangular, square, oval, triangular, cylindrical, multisided (e.g., pentagonal, hexagonal, octagonal, and so forth), other rounded shapes, irregular shapes, and so forth. Hence, possible cross-sectional geometries for the container body and the container cap include round, oval, rectangular, square, triangular, multisided, irregular, and so forth.

In addition, the container cap 10 can have geometry similar to the geometry of the open end 212 of the container body 210 and have a size that enables an outer surface 24 of the cap 10 to engage the container inner surface 214, the container outer surface 216 at the open end 212, and/or the end of the container body 210. In some embodiments, the container can have two open ends, similar to the open end 212 and container caps 10 can be engaged to both the open ends such that the article can be dispensed from both the ends. In one embodiment, the cap can have a diameter (as measured across a major axis of the cap) of about 30 millimeters (mm) to about 120 mm, or, more specifically, about 45 mm to about 100 mm, and, even more specifically, about 55 mm to about 5 mm. These caps are useful with rounded containers, for example, cylindrical and other rounded canisters.

In another embodiment, e.g., with an oval cap and container, the cap can have a major axis of about 100 millimeters (mm) to about 200 mm, or, more specifically, about 120 mm to about 175 mm, and, even more specifically, about 130 mm to about 165 mm. The minor axis can be about 70 millimeters (mm) to about 150 mm, or, more specifically, about 75 mm to about 130 mm, and, even more specifically, about 85 mm to about 110 mm. In one embodiment, the major axis was about 150 mm and the minor axis was about 95 mm.

Figure 3:
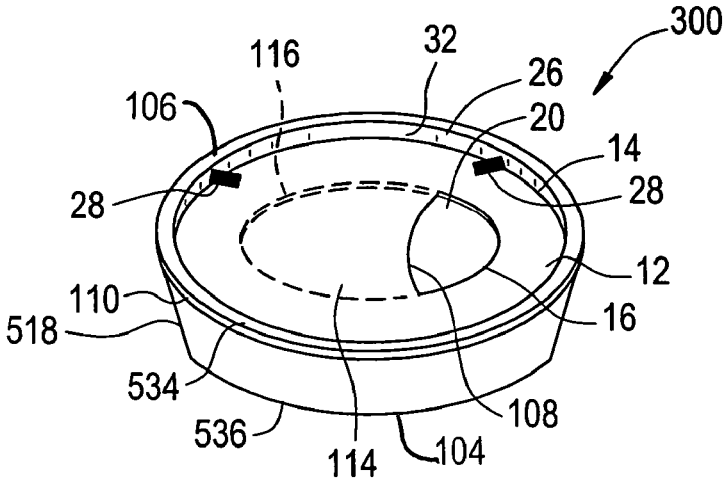
FIG. 3 is a perspective view of another embodiment of a container cap.

Engagement of the inner surface 214 and/or the outer surface 216 can be accomplished with various cap designs. The designs can also facilitate the cap being fixedly disposed in the open end 212 of the container body 210 such that the cap 10, 100, 300, 400, 500, does not move into the container body 210 or dislodge from the container body 210. For example, the skirt 18, 118, 518 can be an angularly extending portion that comprises a smaller opening at a second end 36 compared to a first end 34 (e.g., a decreasing diameter from a first end 534 to a second end 536; i.e., the skirt can converge from the first end 534 toward the second end 536, as is illustrated in FIG. 3). Optionally, the outer surface 24 of the skirt 18 can have a structural feature, e.g., a first projection 102, extending around all or a portion of the outer surface 24 to enhance or support the frictional engagement of the outer surface 24 of the skirt to the container inner surface 214 and/or the container outer surface 216; and/or to enable a snap-fit, a one-way lock, and so forth; and the like, as well as combinations comprising at least one of the foregoing. The first projection can provide an interference fit with the container so that the lid remains in the desired location. Possible projections include rib(s), protrusion(s), groove(s), lip(s), shelf(ves), tab(s), barb(s), spoke(s), screw ridge(s), and so forth, as well as combinations comprising at least one of the foregoing projections. For example, the skirt 18, 118, 518 can optionally comprise adhesive, structural feature(s) (e.g., first projection(s)) 102, and so forth, that can engage the inner surface 214 of the container body 210, e.g., to provide a friction fitting and/or to inhibit the cap 10, 100, from dislodging from the container 200 once disposed within the container body 210. Optionally, the cap can be removable to enable refilling of the container.

Another optional feature of the skirt is a lip 110 that can be disposed adjacent (i.e., at or near) the first end 106. (See FIG. 3) For example, if it is desired that the cap be substantially flush with the end of the container body once inserted, the lip can protrude from the first end 106 of the skirt a sufficient distance to enable the lip to engage the container body 210, or, more specifically, the lip 110 can have a width equal to about the thickness of the container wall. This lip can be a single structure extending around the skirt 18, 118, 518 or can comprise multiple lip segments.

Figure 6:
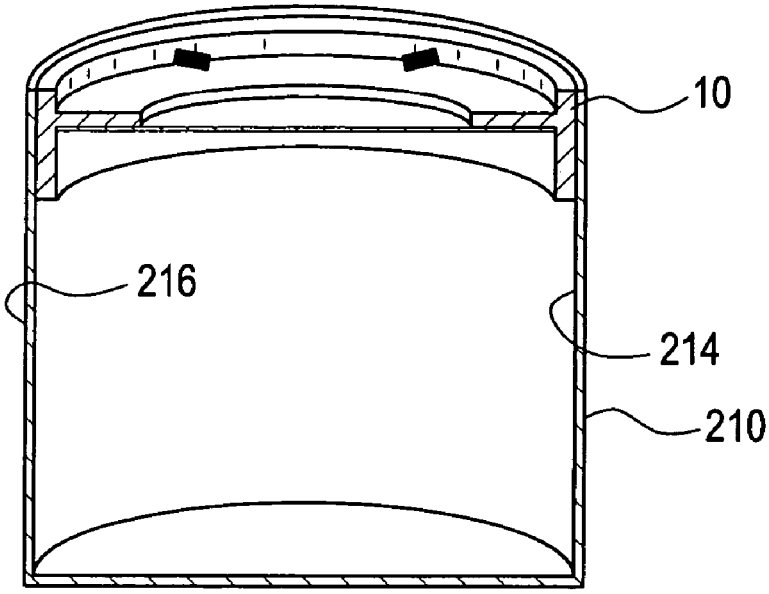
FIG. 6 is a cross-sectional view along line 6-6 of the embodiment of a container with a container cap of FIG. 5.
Figure 7:
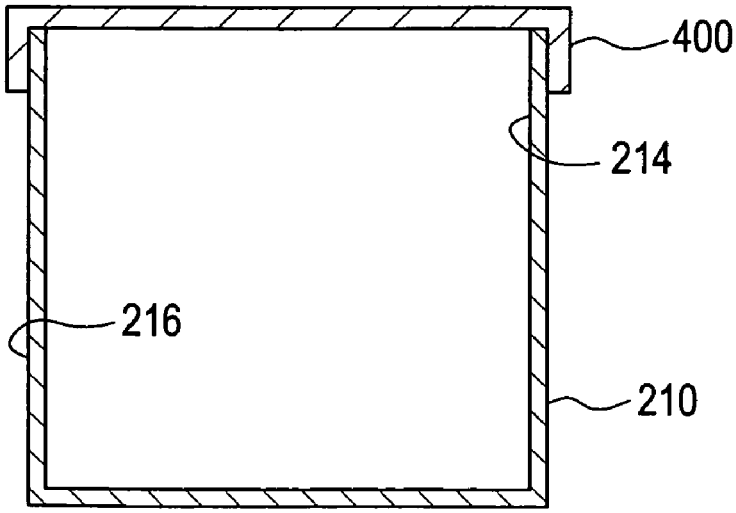
FIG. 7 is a cross-sectional view of another embodiment of a container with a container cap engaging an outer surface of the container.
Figure 8:
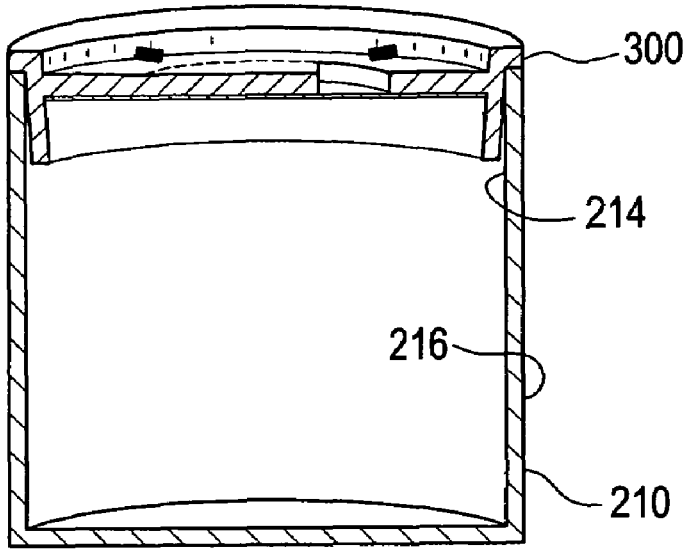
FIG. 8 is a cross-sectional view of a container with the container cap of FIG. 3.
Figure 9:
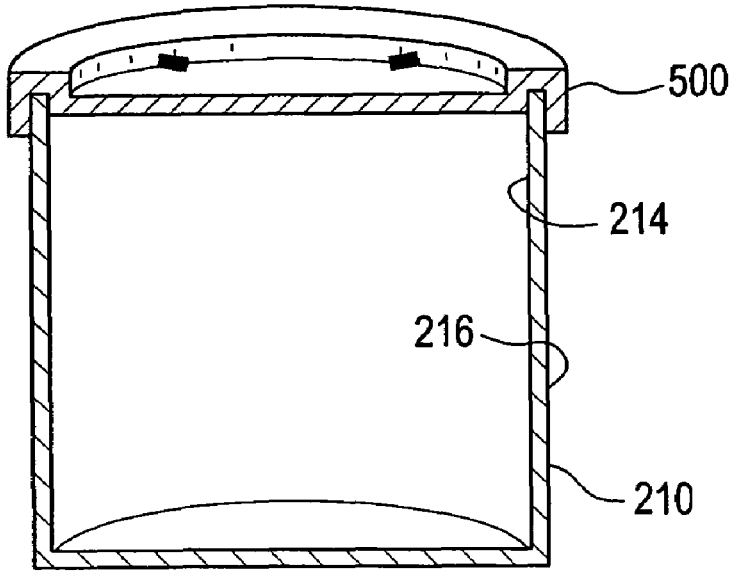
FIG. 9 is a cross-sectional view of yet another embodiment of a container with a container cap engaging an inner surface and an outer of the container.
Figure 10:
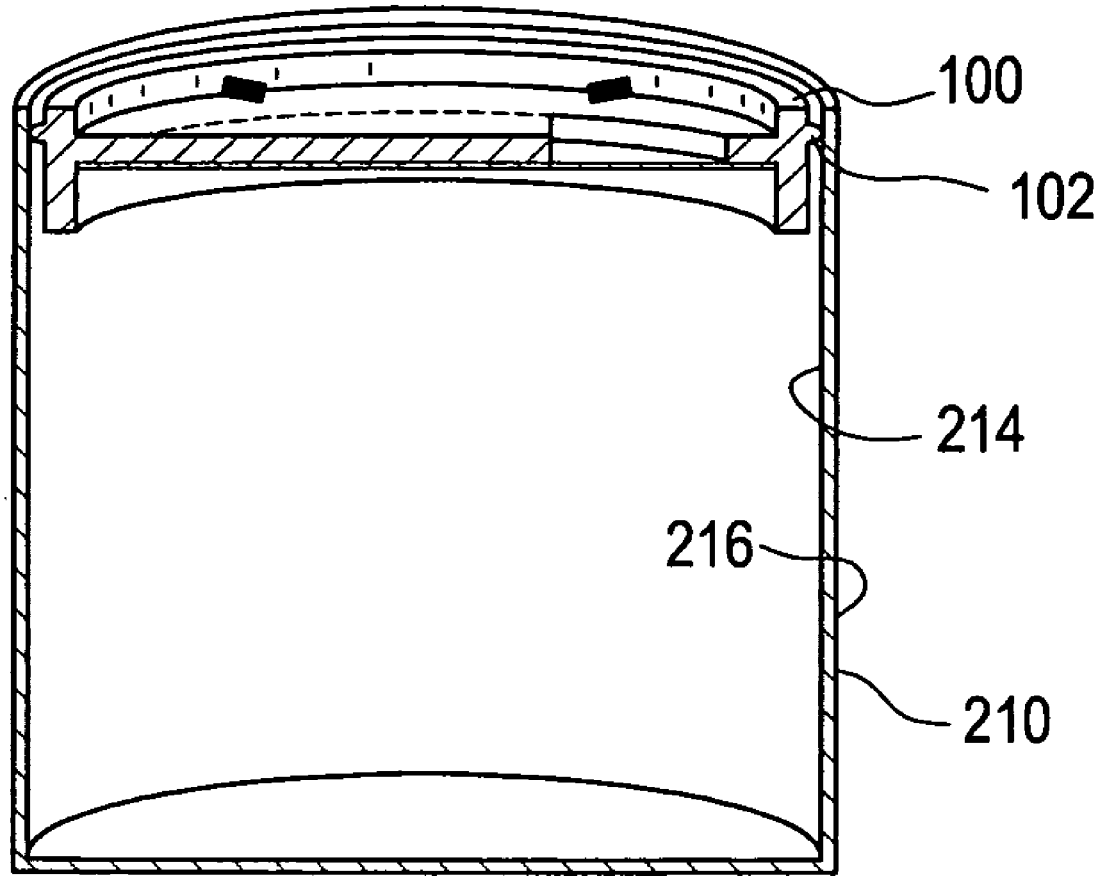
FIG. 10 is a cross-sectional view of a container with the container cap of FIG. 2.

FIGS. 6-11 illustrate various exemplary engagements of the cap 10 with the inner surface 214 and/or outer surface 216 of the container body 210 using various cap designs. FIGS. 6, 8, and 10 illustrate the engagement with the inner surface 214. In FIG. 10, first projection(s) 102 is shown that provides frictional engagement to the container body 210, e.g., forming an interference fit. FIG. 7 illustrates engagement with the outer surface 216, and FIG. 9 illustrates engagement with the inner surface 214 and the outer surface 216.

In addition to providing engagement with the container body 210, the skirt 18 can engage and provide structural integrity to the covering, or, more specifically, to the first panel 12. The support can be provided in various fashions, such as the use of second projections 28 disposed around the skirt 18, and so forth. The second projection(s) (e.g., spoke(s)) 28, for example, can extend inward from (e.g., at or near) an inner surface 26 of the skirt 18 such that they engage the first panel 12 and/or can extend around the interior of the skirt 10.

Further structural integrity can be provided by optional third projection(s) (e.g., rib(s) 32), which can extend along the skirt, e.g., between the first end 106 and the second end 104 (and optionally, from the first end 106 to the second end 104). These third projection(s) 32 can strengthen the connection between the skirt and the first panel and can serve to enhance the gripping of the container cap 10 when engagement or removal from the container body 210 is desired.

The skirt 18 can comprise a material having sufficient structural integrity to be inserted into the open end 212 of container body 210 so as to engage the inner surface 214, such as a moldable thermoplastic material, fibrous material (e.g., having sufficient rigidity), and so forth. Exemplary thermoplastic materials include, but are not limited to, polyolefins, polyesters, polyamides, polycarbonates, polyurethanes, polyvinylchloride, polytetrafluoroethylene, polystyrene, polyethylene terephathalate, biodegradable polymers (such as polylactic acid), and copolymers and blends thereof. Suitable polyolefins include, but are not limited to, polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene, and blends thereof; polybutylene, e.g., poly(1-butene) and poly(2-butene); polypentene, e.g., poly (1-pentene) and poly(2-pentene); poly(3-methyl-1-pentene); poly(4-methyl 1-pentene); and so forth, as well as combinations comprising at least one of the foregoing polyolefins.

Exemplary copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and so forth, as well as combinations comprising at least one of the foregoing polyamides. Suitable polyesters include polyethylene terephthalate, polytrimethylene terephthalate, polybutylene terephthalate, polytetramethylene terephthalate, polycyclohexylene-1,4-di-methylene terephthalate, and isophthalate copolymers thereof, and so forth, as well as combinations comprising at least one of the foregoing polyesters. Other possible materials include combinations comprising at least one of any of the above materials.

The covering (e.g., the first panel 12 and the second panel 114), or a portion thereof, can be employed to protect the product within the container and/or enhance product distinction and/or discrimination; e.g., the first panel can have a geometry that facilitates product discrimination and distinction. The covering can comprise any material that provides the desired structural integrity and can be bonded or otherwise attached to the dispensing window 20. Desirably, the material can have a surface capable of receiving graphics, for example, the material can be paperboard, poster board, carton board, cardboard, polymeric materials (such as thermoplastics, e.g., poly film wrap, and the like), nonwoven material (e.g., natural and/or synthetic nonwoven material), and so forth, as well as combinations comprising at least one of the foregoing materials. Optionally, the first panel 12 and the second panel 114 can comprise different materials.

The first panel 12 can have a size and geometry to retain the dispensing window 20, allow removal of the articles through the dispensing window 20, and engage the skirt 18. For example, the first panel 12 can form a ring around the interior of the skirt 18, extending toward a center of the skirt 18. This first panel 12, can contact the inner surface 26 of the skirt 18, optionally being held in place by one or more spokes 28 and/or ribs 32, and/or the first panel can extend around the skirt 18, around the second end 104 toward the first end 106 along the outer surface of the skirt 18 (e.g., in this embodiment, the first panel 12 would form the outer surface 24 of the cap). The covering also comprises the second panel 114. The design of the second panel 114 can retain the integrity of the article (e.g., cleanliness, and so forth), can enable access to the dispensing window 20 and hence to the articles contained in the container body and can also enhance product differentiation and aesthetics of the product. The second panel 114 can be separated from the first panel 12 via perforations, marks, score lines, and so forth, that form zones of decreased structural integrity on the covering such that the second panel can be readily removed when desired, while remaining intact when removal is not desired. The second panel 114 can also have a removal zone. This zone can be designed to enable gripping of the second panel 114 for removal from the covering. The size and shape of the removal zone 108 can be sufficient to enable a finger to engage the second panel 114, passing between the second panel 114 and the dispensing window 20.

Various processes can be employed to form the cap with the covering. For example, an injection molding process can be employed using the covering as a preform. Upon injection, the molten thermoplastic material adheres to the covering, attaching the skirt 18 to the covering. For example, the injection molding can be preformed in a mold with a configuration that ensures an equal distribution of the thermoplastic material to form a high quality injection molded cap. Multiple injection points can be employed to enable an equal distribution of thermoplastic material around the mold to produce a cap of high quality, having a skirt of sufficient thickness. Desirably, the thermoplastic material can be injected against a top surface of the covering so that the size of the mold has more available space for any injection nozzle apparatus. Additional processes for forming container caps are disclosed in U.S. Pat. No. 5,647,501A entitled Composite Lid for Container, U.S. Pat. No. 6,053,353A entitled Composite Container Closure, U.S. Pat. No. 6,196,451B1 entitled Paper-Sided Composite Lid, U.S. Pat. No. 6,471,083B1 entitled Induction-Sealed Composite Container End Closure, and U.S. Pat. No. 6,523,713B1 entitled Stackable Hinged Container Lid Having Detents.

The dispensing window 20 can be attached (e.g., bonded) to the first panel 12 in various fashions, such as thermal bonding (e.g., pattern bonded), ultrasonically, adhesively (e.g., adhesive, resin, latex, and so forth), and/or mechanically (e.g., through-air dried attachment, and so forth) bonded. The poly window could be an in-mold label execution where the window becomes an integral part of the plug during the molding operation. The poly window can be a co-molded dispensing orifice and so forth, such as those described in commonly assigned U.S. Pat. Nos. 6,585,131, 6,592,004, and 6,766,919. Optionally, the dispensing window could be fingers cut into cardboard or the like, rather than a poly film (e.g., directly into the second panel, wherein the dispensing window 20 is formed by the panels). For example, the dispensing window 20 can be bonded using continuous seams or patterns. As additional examples, the dispensing window 20 can be bonded along the outer periphery 14 of the first panel 12 and/or can attach to a side of the first panel opposite the first end of the skirt 18.

The dispensing window 20 can comprise a dispensing window material that can attach to the material of the first panel 12 and that can be used to provide acceptable dispensing. Desirably, the dispensing window material can be easily cut through to form the dispensing aperture 22 having a desired pattern. Exemplary dispensing window materials include, but are not limited to, polymeric materials such as polyethylenes, polypropylenes, polyesters, polyvinyl chlorides, thermoset rubbers, and thermoplastic elastomeric materials; natural and/or synthetic nonwoven materials; paper materials such as paperboards, poster boards, carton boards and cardboard, and so forth, as well as combinations comprising at least one of the foregoing dispensing window materials. Suitable thermoplastic elastomeric materials include, but are not limited to, styrenic based thermoplastic elastomeric materials, ethylene-methyl acrylate copolymers, polyurethane, amides, olefinic based thermoplastic elastomeric materials, olefinic vulcanizates, polyesters, and so forth, as well as combinations comprising at least one of the foregoing thermoplastic elastomeric materials.

The dispensing aperture(s) 22 can have a pattern suitable for easy dispensing of the article from the container. Suitable patterns include, X-patterns, Y-patterns, double Y-patterns, I-patterns, slits, V-patterns, wavey patterns (e.g., waves, serrated, and so forth), circular patterns (e.g., circle, oval, and so forth), triangular patterns, irregular patterns, and other geometrical shapes, as well as patterns described in U.S. Pat. Nos. 6,585,131, 6,592,004, and 6,766,919, and combinations comprising at least one of the foregoing patterns. For example, when the article is dispensed from the container, the X pattern dispensing aperture opens, e.g., forming four triangles and allowing easy dispensing of the article.

The cap 10, 100, 300 can be disposed in an end of a container body 210. The container body 210 houses articles (e.g., disposable sheets, tissues, and so forth). The articles can be disposed within the container to facilitate removal via the dispensing slit(s) 22. For example, disposable sheets may be rolled (e.g., rolled and perforated), folded, or otherwise disposed inside the container body 210. Suitable folding techniques for disposable sheets include, but are not limited to, c-folding, v-folding, interfolding, multi-folding, and so forth, as well as combinations comprising at least one of the foregoing folding techniques.

The container 200 can be used for dispensing disposable sheets, e.g., tissue products, paper products, non-woven polymer products, and so forth, as well as combinations comprising at least one of the foregoing, e.g., moist wipes, substantially dry wipes, tissue paper, and so forth. Possible disposable sheets include, but are not limited to, writing articles, printing articles, wrapping articles, sanitary articles, industrial papers, newsprint articles, linerboard articles, tissue products such as, bath tissue, facial tissue, and towels, and so forth, along with other cellulose structures including absorbent pads, intake webs in absorbent articles such as diapers, bed pads, moist wipes (e.g., commonly referred to as wet wipes), substantially dry wipes (e.g., wipes impregnated with a desired cleanser, lotion, and/or the like, and dried) meat and poultry pads, feminine care pads, and so forth, as well as combinations comprising at least one of the foregoing.

The container caps provide a low cost method and dispensing feature for dispensing disposable sheets from a container. The dispensing aperture 22 on the dispensing window 20 allows for an easy dispensing of disposable sheets from the container. Also, the container caps can provide a covering for the articles inside the container. This arrangement, for example, enables the production of tissue containers that can be held in an automobile cup holder (e.g., a round holder), and allows tissues to be readily dispensed therefrom.

The cap design also provides a medium (e.g., an advertising medium) for displaying high quality graphics that identify the product and its source. The graphics can be present on a top surface and/or a bottom surface of the second panel 114. Suitable graphics include, but are not limited to, coupon(s), product information, advertising, tamper resistance information, and so forth, as well as combinations comprising at least one of the foregoing. Alternatively, or in addition, the dispensing window can comprise graphics in the form of coupons and labels.

Optionally, the container cap may be a simulant of the appearance and texture of the disposable sheets inside the container. For example, a matte finish simulating the appearance of the disposable sheet can be provided by printing a desired pattern on the container cap and thereafter laminating a matte material, such as a translucent polymeric film, over the printed pattern. A matte or textured finish simulating the texture and/or appearance of a disposable sheet can also be produced by printing the container cap with a matted (i.e., dull finish) ink, by lacquering at least one surface of the packaging material with a dull finish lacquer or a matting lacquer, by embossing the container cap to provide an embossed pattern simulating the weave or texture of the article, or by embossing and printing the container cap to provide embossed and printed patterns wherein the embossed and printed patterns may be in registry, out of registry, or wherein a portion of the embossed and printed patterns are in registry and a portion of the embossed and printed patterns are out of registry.

In some embodiments, the container caps can comprise additional panels/components attached to the container caps. Such additional panels/components can comprise switches, tabs, and the like, that can be activated by exerting a physical force such as pressing the switch using fingers. The switch can be used to generate a desired sound (e.g., music, beeping, talking (e.g., instructions), and so forth), smell, and so forth, as well as combinations comprising at least one of the foregoing. Also, these panels/components can comprise additional product information, advertisement of the products inside the container and/or of other products, coupons, looking mirrors, and so forth, as well as combinations comprising at least one of the foregoing. For example, a sample of a different product can be attached to the outer surface of the cover, and/or a coupon for a refill, for a different product, or for another purchase of the product can be disposed, attached to, written on, or disposed under the second panel (e.g., between the second panel and the dispensing aperture, and so forth. The additional panels/components can be easily attached to the container caps since the container caps are manufactured independently and then engaged with a container.

Thus, the paperboard first panel and second panel of the container cap provides the means for presenting complex, colorful and detailed graphics such as illustrations of the product, company trademarks and trade dress designs, while the skirt of the container cap comprising a thermoplastic material provides a durable covering for a container for dispensing disposable sheets.

All patents, patent applications, and articles referred to herein are hereby incorporated by reference. If there is any conflict between this application and the materials incorporated by reference, this application shall be the controlling document.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A container cap comprising a covering comprising a first panel, wherein the first panel has an outer periphery and an inner periphery, and a first side and a second side, a skirt in contact with the first panel, and a dispensing window material attached to the first side of the first panel, wherein the dispensing window material has a dispensing aperture capable of allowing dispensing of an article through the dispensing aperture.

2. The container cap of claim 1, wherein the dispensing aperture has a pattern selected from the group consisting of X-patterns, Y-patterns, double Y-patterns, l-patterns slits, V-patterns, wavey patterns, circular patterns, triangular patterns, irregular patterns, and combinations comprising at least one of the foregoing patterns.

3. The container cap of claim 1, wherein the article is selected from the group consisting of tissue products, paper products, non-woven polymer products, moist wipes, substantially dry wipes, and combinations comprising at least one of the foregoing articles.

4. The container cap of claim 1, wherein the covering further comprises a second panel joined to the inner periphery of the first panel along a weakened line, wherein the second panel comprises a removal zone.

5. The container cap of claim 1, wherein the covering comprises a covering material selected from the group consisting of paperboard, poster board, carton board, cardboard, and combinations comprising at least one of the foregoing covering materials.

6. The container cap of claim 1, wherein the skirt comprises a thermoplastic material.

7. The container cap of claim 1, wherein the dispensing window material comprises a material selected from the group consisting of polymeric material, natural and/or synthetic non-woven material, paper material, and combinations comprising at least one of the foregoing.

8. The container cap of claim 1, wherein the skirt comprises a first end and a second end and wherein the covering extends around the skirt such that the second side of the covering covers at least a portion of an outer surface of the skirt.

9. The container cap of claim 7, wherein the second end of the skirt has a smaller opening than the first end of the skirt.

10. The container cap of claim 1, wherein the skirt further comprises a first projection disposed around at least a portion of an outer surface of the skin.

11. The container cap of claim 1, wherein the skirt further comprises a second projection that extends inward from the inner surface and engages a top surface of the covering.

12. The container cap of claim 11, wherein the skirt further comprises a first projection that extends around the first panel.

13. The container cap of claim 12, wherein the first projection is segmented.

14. The container cap of claim 12, wherein the skirt further comprises a third projection disposed on an inner surface, between the first end and the second end.

15. The container cap of claim 1, wherein the skirt further comprises a third projection disposed on an inner surface, between the first end and the second end.

16. The container cap of claim 1, wherein the skirt further comprises a lip disposed adjacent the first end.

17. A container cap, comprising:

a covering comprising a first panel and a second panel, wherein the first panel has an outer periphery, an inner periphery, a first side, and a second side, wherein the second panel comprises a removal zone and is joined to the inner periphery along a weakened line;

a skirt in contact with the first panel, wherein the skirt comprises a first projection; and a dispensing window material attached to the first side of the first panel, wherein the dispensing window material has a dispensing aperture capable of allowing the dispensing of an article through the dispensing aperture.

18. A container, comprising:

a container body having an open end, a container inner surface, and a container outer surface, the container body capable of housing articles; and a container cap disposed in physical contact with the container body at the open end, wherein the container cap comprises a covering comprising a first panel, wherein the first panel has an outer periphery, an inner periphery, a first side, and a second side;

a skirt in contact with the first panel; and a polymeric film attached to the first side of the first panel, wherein the polymeric film has a dispensing aperture capable of allowing dispensing of an article from the container.

19. The container of claim 18, wherein the skirt engages the container inner surface, 20. The container of claim 18, further comprising an article disposed in the container, wherein the article is selected from the group consisting of tissue products, paper products, non-woven polymer products, and combinations comprising at least one of the foregoing.

21. The container of claim 18, wherein the covering further comprises a second panel joined to the inner periphery of the first panel along a weakened line, wherein the second panel comprises a removal zone.

22. The container of claim 18, wherein the container body comprises a container material selected from the group consisting of paperboard, poster board, carton board, cardboard, and combinations comprising at least one of the foregoing container materials.

23. The container of claim 18, wherein a diameter of the container cap at a first end is greater than a diameter of the container cap at a second end, and wherein the first end is disposed on the same side of the container cap as the first side of the first panel.

24. The container of claim 18, wherein the container body and the container cap have a cross-sectional geometry selected from the group consisting of round, oval, rectangular. square, triangular, multi-sided, and irregular.

25. A container cap, comprising:

a covering comprising a first panel and a second panel, wherein the first panel has an outer periphery, en inner periphery, a first side, and a second side, wherein the second panel comprises a removal zone and is joined to the inner periphery along a weakened line; the covering comprising a material selected from the group consisting of paperboard, poster board, carton board, and cardboard;

a skirt comprising a thermoplastic material molded about the outer periphery of the first panel, wherein the skirt comprises an outer surface having a first projection; and a dispensing window material comprising a polymeric film attached to the first side of the first panel, wherein the dispensing window material has a dispensing aperture capable of allowing the dispensing of an article through the dispensing aperture.

26. The container cap of claim 25 wherein the first projection comprises a barb that enables a one-way lock with a container body having an open end.

27. The container cap of claim 25 wherein the first projection comprises a rib that enables a snap-fit with a container body having an open end.

28. The container cap of claim 26 wherein the first projection extends around all of the outer surface of the skirt.

29. The container cap of claim 27 wherein the first projection extends around all of the outer surface of the skirt.

30. The container cap of claim 26 wherein the container cap and the container body both comprise an oval shape.

31. The container cap of claim 26 wherein the container body comprises a container materiel selected from the group consisting of paperboard, poster board, carton board cardboard, and combinations comprising at least one of the foregoing container materials.

32. The container cap of claim 31 comprising an article disposed in the container body, wherein the article is selected from the group consisting of bath tissue, facial tissue, towels, and substantially dry wipes.

33. The container cap of claim 25 comprising a lip that protrudes from a first end of the skirt and the lip having a width such that the container cap is substantially flush with a container wall of a container body once the container cap is inserted.

* * * * *